US009003967B2

(12) United States Patent
Reed et al.

(10) Patent No.: US 9,003,967 B2
(45) Date of Patent: Apr. 14, 2015

(54) LIQUID EXTRACTION FOR TRASH COMPACTOR

(75) Inventors: Fred Reed, Brea, CA (US); Thomas Lee, Coto De Casa, CA (US)

(73) Assignee: MAG Aerospace Industries, LLC, Carson, CA (US)

( * ) Notice: Subject to any disclaimer, the term of this patent is extended or adjusted under 35 U.S.C. 154(b) by 180 days.

(21) Appl. No.: 13/094,277

(22) Filed: Apr. 26, 2011

(65) Prior Publication Data

US 2011/0259210 A1 Oct. 27, 2011

Related U.S. Application Data

(60) Provisional application No. 61/343,246, filed on Apr. 26, 2010.

(51) Int. Cl.

| | |
|---|---|
| ***B30B 9/04*** | (2006.01) |
| ***B30B 9/06*** | (2006.01) |
| ***B30B 9/26*** | (2006.01) |
| ***B30B 9/30*** | (2006.01) |

(52) U.S. Cl.
CPC ... *B30B 9/06* (2013.01); *B30B 9/26* (2013.01); *B30B 9/3039* (2013.01)

(58) Field of Classification Search
USPC ..... 100/104, 90, 110, 116, 126, 111
See application file for complete search history.

(56) References Cited

U.S. PATENT DOCUMENTS

| | | | | | |
|---|---|---|---|---|---|
| 1,131,142 | A | * | 3/1915 | Karcher | 100/227 |
| 2,109,559 | A | | 3/1938 | Wickert, Jr. | |
| 2,221,806 | A | | 11/1940 | Loomis | |
| 2,817,290 | A | * | 12/1957 | Parker et al. | 100/102 |
| 3,717,085 | A | * | 2/1973 | Sato | 99/516 |
| 3,736,863 | A | * | 6/1973 | Brucker | 100/45 |
| 3,833,767 | A | * | 9/1974 | Wolf | 704/204 |
| 3,835,767 | A | * | 9/1974 | Peterson | 100/345 |
| 3,903,790 | A | * | 9/1975 | Gladwin | 100/215 |
| 3,922,962 | A | * | 12/1975 | Goldkuhle | 100/345 |
| 4,113,620 | A | * | 9/1978 | Thomsen | 162/230 |
| 4,273,037 | A | | 6/1981 | Ruebesam | |
| 4,444,099 | A | * | 4/1984 | Paleschuck | 100/127 |
| 4,748,905 | A | * | 6/1988 | Langdon | 100/90 |
| 5,448,945 | A | * | 9/1995 | Taylor et al. | 100/100 |
| 6,110,388 | A | * | 8/2000 | Norais et al. | 210/770 |
| 6,640,701 | B2 | | 11/2003 | Hoffjann et al. | |
| 2002/0185016 | A1 | | 12/2002 | Hoffjann et al. | |

FOREIGN PATENT DOCUMENTS

| | | |
|---|---|---|
| DE | 10253328 | 5/2004 |
| EP | 0838254 | 4/1998 |

(Continued)

OTHER PUBLICATIONS

International Search Report and Written Opinion dated Jul. 14, 2011 in related Applicaton No. PCT/US2011/033865.

(Continued)

*Primary Examiner* — Jimmy T Nguyen
*Assistant Examiner* — Chwen-Wei Su
(74) *Attorney, Agent, or Firm* — Kilpatrick Townsend & Stockton LLP; Dean W. Russell, Esq.; Kristin M. Crall, Esq.

(57) ABSTRACT

Embodiments of the present relate generally to devices and methods for separating and removing liquid waste from mixed waste. One embodiment relates to a trash compactor having a suction line for removing collected liquid. A further embodiment relates to a trash compactor having a sloped platen for allowing liquid to collect for subsequent removal or drainage.

6 Claims, 3 Drawing Sheets

(56) References Cited

FOREIGN PATENT DOCUMENTS

| | | |
|---|---|---|
| GB | 2158466 | 11/1985 |
| JP | 5293737 | 11/1993 |
| WO | 2004037529 | 5/2004 |
| WO | 2011137092 | 11/2011 |

OTHER PUBLICATIONS

International Preliminary Report on Patentability dated Nov. 8, 2012 in Application No. PCT/US2011/033865.

* cited by examiner

LIQUID EXTRACTION FOR TRASH COMPACTOR

This application claims the benefit of U.S. Provisional Application Ser. No. 61/343,246, filed Apr. 26, 2010 titled "Water Extraction for Trash Compactor," the entire contents of which are hereby incorporated by reference.

FIELD OF THE INVENTION

Embodiments of the present invention relate generally to devices and methods for separating and removing liquid waste from mixed waste rubbish, and are particularly useful on-board passenger transport vehicles.

BACKGROUND

The catering process in a passenger transport vehicle, such as an aircraft, train, bus, RV, ship, or other water or air travel vessel often involves collecting mixed waste (i.e., waste that includes solid materials as well as liquid materials). For example, after beverage service, unused items are collected, and it is often the case that ice and other liquids may still be present in cups that are disposed of trash bags. In addition to liquids, solid-like materials are also collected, such as cups, napkins, tea bags, food wrappers, beverage cans, forks, and other packaging or non-consumable items, and food wastes such as leftover sandwiches, fruit cores, or any other type of disposable item that a passenger may consume or bring on-board. Typically, this mixed waste is not separated, but is collected in a single trash bag and disposed of in a single trash compactor. Even if the wastes are coarsely separated during collection (which takes extra time, can be messy, and cannot be completely thorough), it is still often the case that liquids and solids will be mixed together at some level.

During trash compaction cycle of refuse that contains both a solid waste aspect and a liquid aspect, it has traditionally been the case that the two mediums would simply be mixed, and any leakage that may occur has been dealt with as a necessary consequence. However, this can create a messy workspace, particularly on-board a passenger transport vehicle, where space and materials are at a premium in a galley.

One attempted solution has been to extract liquid through the bottom of the compacting compartment that contains the solid mixed waste trash. The problem with this attempted solution is that it is difficult to separate the liquid from the solid trash in a harsh environment. For example, the platen exerts a great deal of pressure on the waste, destroying any elastomeric seals below. If a screen, a metallic filter, or drain is used at the base of the compactor, it will be difficult to remove the compacted solid waste without leaking residual liquid.

Accordingly, it has been the standard to date to simply contain the liquid with the solids in the box or bin containing the trash to be compacted. However, in the event that the box or bin is penetrated or otherwise compromised, liquid can escape and leak onto the floor. Again, this is particularly undesirable in the tight confines of a galley, where safety concerns are heightened. Particularly in today's competitive airline market, cabin space is a valuable commodity. As the airlines compete to create more passenger space, the storage of trash becomes a critical concern, and new innovations and solutions are continually needed and expected.

BRIEF SUMMARY

Embodiments of the present relate generally to devices and methods for separating and removing liquid waste from mixed waste rubbish. One embodiment relates to a trash compactor having a suction line for removing collected liquid. A further embodiment relates to a trash compactor having a sloped platen for allowing liquid to collect for subsequent removal or drainage.

One embodiment provides a method for removing liquid from mixed waste collected in a trash compactor, comprising providing a platen for compacting the mixed waste, the platen having an upper surface; and providing a liquid removal system associated with the upper surface of the platen for removing liquid collected near platen edges or on or near the upper surface of the platen during the compacting process.

A further embodiment provides a trash compactor, comprising a waste receiving container configured to receive mixed waste comprised of solid waste and liquid waste; a platen for applying pressure to and compressing mixed waste contained in the waste receiving container; and a vacuum line associated with the platen, the vacuum line configured to suction liquid waste collected on or through at least a portion of the platen.

A further embodiment provides a trash compactor, comprising: a waste receiving container configured to receive mixed waste comprised of solid waste and liquid waste; a platen for applying pressure to and compressing waste contained in the waste receiving container, the platen comprising an upper surface having at least a slight downward slope.

DETAILED DESCRIPTION

The present inventors have determined that extracting the liquid out of mixed waste can help prevent liquid leakage and spillage that can be messy and unsafe, but also recognize that focusing removal efforts at the bottom of the waste receptacle are not optimal. The general concept developed is to remove excess liquid away from the top of the platen portion of the trash compactor. This may accomplished by either using suction or vacuum to drawn liquid away from areas on or around the platen, or by using a gravity drain path to direct liquid away from the top of the platen. In short, the excess liquid is extracted from the upper portion of the collected mixed waste.

Figure 3:
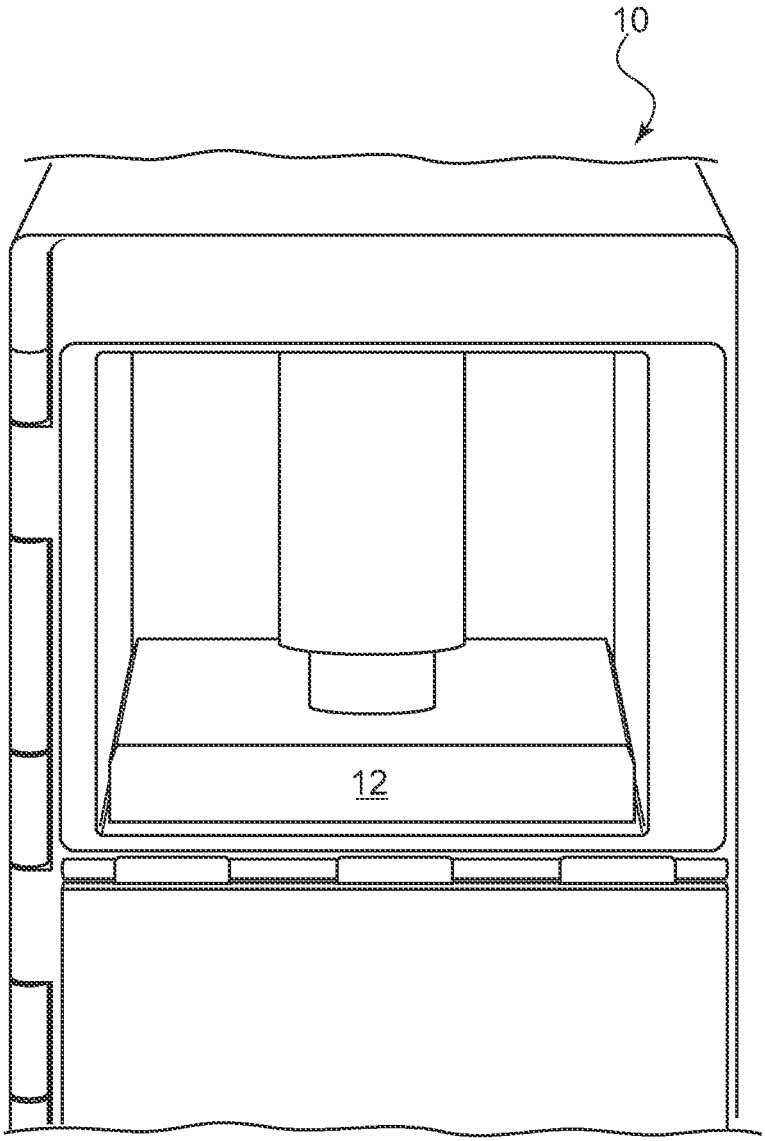
FIG. 3 shows a prior art trash compactor with a platen during use.

As background, during a trash compaction cycle, collected waste contained in an appropriate waste receptacle is compressed. An example of compression in process is shown in FIG. 3, which illustrates a trash compactor 10 having a traditional platen 12 in its downward movement. To accomplish compression, the platen 12, which is a flat plate that is configured to be pressed with force against the waste, is lowered against the mixed waste. The force and pressure of the platen 12 compresses the waste into a smaller volume, allowing more waste to be collected and stored in the same waste receptacle, and saving valuable space. However, during the compaction process, liquid waste often bubbles up and through the mixed waste.

Figure 1:
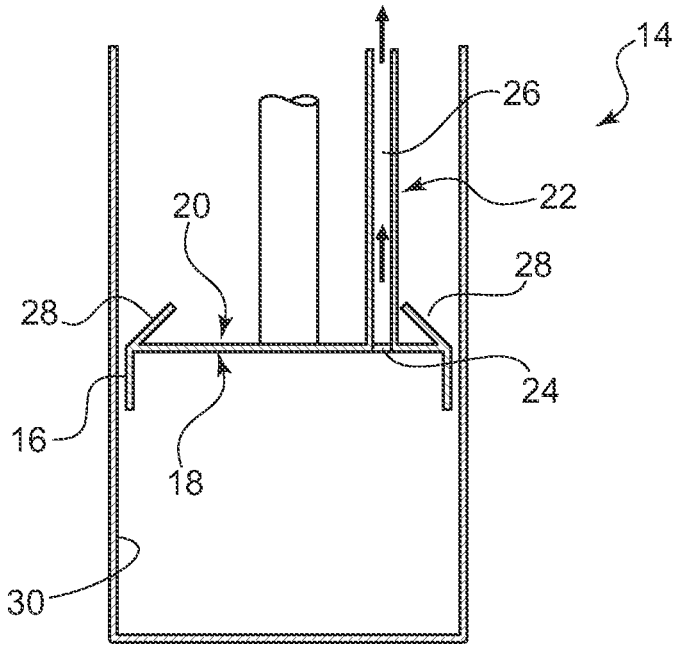
FIG. 1 shows a schematic side plan view of one embodiment of a platen having a liquid removal system.

Accordingly, a first embodiment provides an apparatus and method for vacuuming or suctioning the liquid waste that bubbles up during the compaction process. FIG. 1 shows a schematic view of a suction trash compactor system 14. The system 14 includes a platen 16 having an lower surface 18 and an upper surface 20. The lower surface 18 is the portion of the platen that contacts and compresses waste. A liquid removal system, such as vacuum line 22, is configured to be associated with the upper surface 20. Vacuum line 22 is generally provided between the upper hydraulic/motor portion of the trash compactor and the platen. In the particular embodiment shown, the vacuum line 22 is a vacuum tube, but it should be understood that any appropriate form of vacuum delivery line may be used and is considered within the scope of this application. The vacuum line 22 may be part of a vacuum system, which includes vacuum line 22 and a vacuum source. (The source of vacuum may be derived from any appropriate vacuum-generating source on-board the vehicle, such as a vacuum pump within the compactor system or a pre-existing vacuum source that already exists on-board the vehicle, such as the on-board toilet system of an aircraft.)

The vacuum line 22 may have its suction end 24 secured to or otherwise attached to the platen, or suction end 24 may simply be positioned near enough to the platen that suction can be accomplished. For example, the body of the vacuum line may be secured within and extending from an inner surface of the compactor, and have its suction end 24 extending toward and close to the platen, but not necessarily touching the platen. The body 26 of the vacuum line 22 may be flexible, expandable or stretchable so that the suction end 24 can be maneuvered and directed close to the platen for suction when appropriate. Alternatively, the suction end 24 may directly touch the platen or otherwise be secured to the platen so that vacuum line 22 stays in place (i.e., secured to the platen) during movement of the platen. In this embodiment, the body 26 of the vacuum line 22 may be flexible or stretchable so that it moves with the platen 16, or it may simply be provided at a length such that the tubing can move up and down with the platen, with the excess tubing being maintained above the platen when the platen is at its highest position in the compactor system.

Optional deflectors 28 may also be associated with or attached to the upper surface 20 of the platen to prevent liquid from splashing above the platen. As shown in FIG. 1, deflectors 28 may be positioned at an angle with respect to upper surface 20 such that they create about a 45° angle between the platen and the inner wall 30 of the trash compactor.

In use, a vacuum source presents vacuum to extract liquid (and any other fluid-like materials, including combinations of liquid and paste-like trash) that surface during and after compression of the mixed waste. The suction end 24 of the vacuum line 22 either scavenges the liquid from the back, edges, or upper surface of the platen. One particularly effective method is to allow the platen to press or compact the mixed waste to a level lower than an original waste level, and when the platen dwells in the lower level position, apply vacuum to remove excess liquid that pools or collects on the sides, edges, or on or near the upper surface of platen. The removed liquid can either be collected in a container and removed between flights or trips, or transferred into the grey or black water systems already present on-board an aircraft or other vehicle.

In one particular embodiment, the platen may be provided with a screen or other porous medium through which liquid may be suctioned. The screen or porous medium may comprise a substantial part of the platen, a single screen or porous medium, or a plurality of screens or porous mediums selectively positioned throughout the platen surface.

Figure 2:
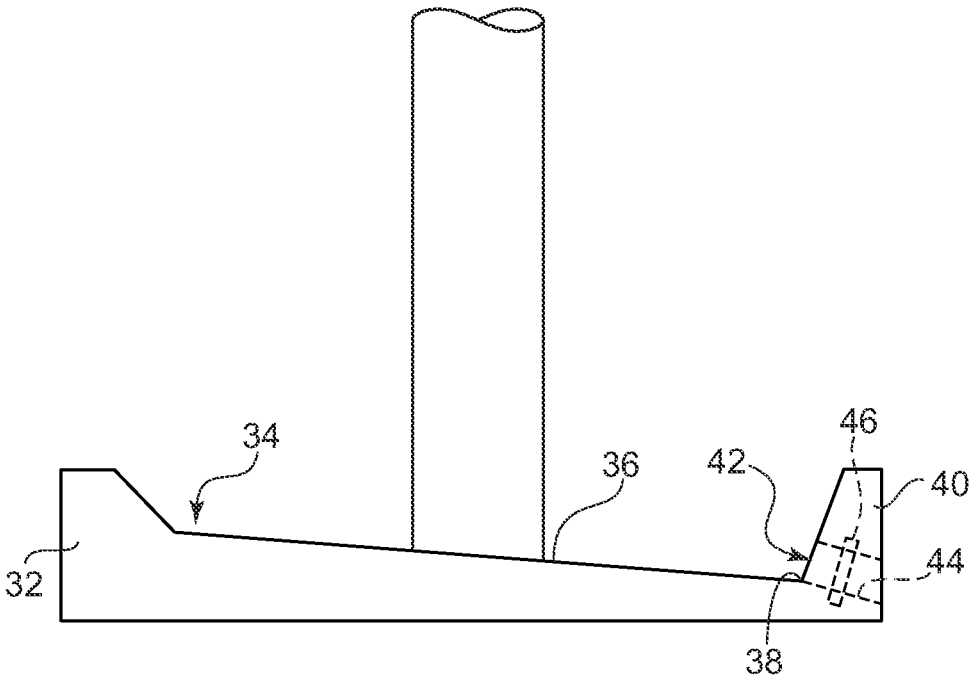
FIG. 2 shows a side plan view of an alternate embodiment of a platen having a liquid removal system.

An alternate embodiment is shown in FIG. 2. In this embodiment, the platen 32 is configured so that it allows liquid waste to pool on the upper surface 34 of the platen, then allows the liquid to drain off the platen at the end of the compaction cycle when the platen is in the home (highest) position. More specifically, during the compaction cycle, liquid may bubble up from the mixed waste during compression. That liquid is allowed to collect or pool on the upper surface 34 of the platen 32. When the platen 32 is lifted up at the end of the compaction cycle, liquid retained on the back of the platen (i.e., the upper surface 34) can be dumped or drained into a collection bin or a suction system.

As shown in FIG. 2, one embodiment of platen 32 is designed with an upper surface 34 having at least a slight downward slope 36. The slope 36 may be directed in any direction, either front-to-back or side-to-side. The purpose of slope 36 is to create a depression on the upper surface 34 of the platen so that any excess liquid is retained during each compaction cycle. In the particular embodiment shown, liquid may be retained between a lowest portion 38 of the slope 36 and a platen side wall 40.

Platen side wall 40 forms an edge of the platen 32. Side wall 40 may be provided with a drain path 42, which is essentially an opening through a lower portion of the side wall 40 that will allow collected liquid to drain. As shown, drain path 42 may also have a slight downward slope 44, which will allow pooled liquid to drain away from the platen 32 via gravity.

Figure 4:
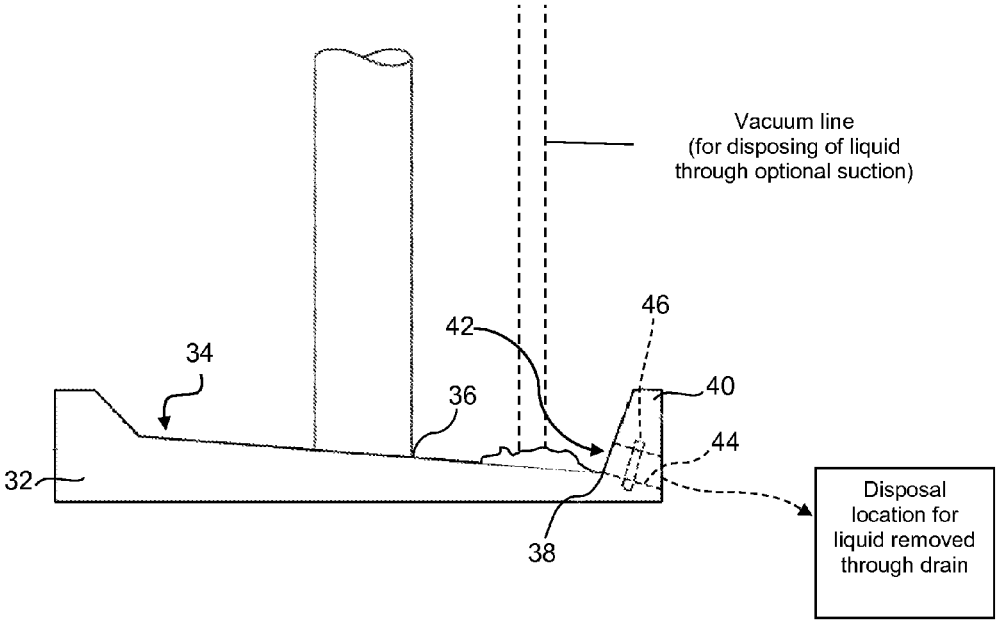
FIG. 4 shows a side plan view of the platen of FIG. 2, with liquid being removed via a vacuum removal system.

Drain path 42 may also be configured with a valve 46 that will operate to open and close in order to control the flow of collected liquid. The valve may be installed at the opening, end, or along any part of the drain path 42 in order to retain the liquid during the return stroke, then discharge the liquid once the platen is at the home (highest) position. Upon retraction (i.e., at the end of a compression cycle) at the home (or uppermost) position of the platen, the valve 46 is opened, which allows the collected liquid to flow by gravity into a drain location. As shown in FIG. 4, the liquid may drain off directly through and into the grey water system, it may drain into the vacuum system via a grey water interface valve, it may be ejected into a drain mast, it may drain into any appropriate retention tank, or it may be collected in a container for later transfer to the grey or black water systems on-board the aircraft, or for any other type of appropriate disposal.

The valve 46 at the drain path could be as simple as a flex hose normally pointed at an angle upward that is defected downward at the home position. Alternatively, the valve 46 may be opened mechanically or electrically, as is known in the general valve art.

Although a single slope is shown in FIG. 2, it should be understood that multiple slopes may be provided. For example, all sides of the upper surface of the platen may slope inwardly toward the center, to form a collection pool at the general center of the platen. Instead of allowing the liquid to drain off one side of the plate via gravity, a suction tube may be provided that can suction the pooled liquid form the center of the platen.

Alternatively, instead of providing a central pooling area, the platen slope may still allow the liquid to pool off to one side, but instead of removing the liquid via a drain path, the liquid may be suctioned from the edges or back surface of the platen, as described in the above vacuum embodiment, and as shown in FIG. 4.

It is also possible to provide one of the above-described wells or depressions on the top of the platen that collect the liquid at the end of the compression cycle, but the liquid may then be suctioned away when the platen is at its upper position in the unit. For example, liquid pools on the upper surface of the platen, as shown in FIG. 4, and when the platen is at its highest or an upper position (e.g., the home position) in the cycle, the pooled liquid comes in contact with a suction line. This prevents a suction line from having to extend all the way downward or to follow the platen during the whole cycle. Instead, the suction line can be mounted or otherwise positioned in an upper area of the compactor unit.

One of the benefits of the sloped platen embodiment is its simplicity. It does not require lines or tubes that could become plugged with debris or congealed liquid. The drain path 42 for the liquid to leave the platen could be designed to be any size, and in some embodiments, can be generally large enough to reduce fouling and offer ease of cleaning. It is also beneficial in that height will not be lost if the hydraulic system can "nest" down into the center rectangular portion of the platen. Moreover, if the drain feature fails for some reason, the unit will still perform exactly the same as a unit without the sloped platen, albeit with some liquid retained on top of the platen.

Changes and modifications, additions and deletions may be made to the structures and methods recited above and shown in the drawings without departing from the scope or spirit of the invention and the following claims.

What is claimed is:

1. A trash compactor configured for use on-board a passenger transport vehicle, comprising:

(a) a waste-receiving container configured to receive mixed waste comprised of solid waste and liquid waste;

(b) a platen for applying pressure to and compressing waste contained in the waste receiving container, the platen comprising an upper surface having at least a slight downward slope from one side to another side, and a platen side wall that forms a raised edge of the platen and creates a space to collect liquid on the upper surface of the platen, wherein the platen side wall further comprises a drain path with a valve.

2. The trash compactor of claim 1, wherein the platen further comprises a depression on the upper surface.

3. The trash compactor of claim 1, wherein collected liquid is vacuumed from the edge of the platen.

4. The trash compactor of claim 1, wherein collected liquid is vacuumed from a space created between the raised edge of the platen and the upper surface of the platen while the platen is at an upper or lower position in the trash compactor.

5. The trash compactor of claim 1, wherein the trash compactor is configured for installation on-board an aircraft.

6. The trash compactor of claim 1, wherein the valve directs the collected liquid to a grey water system, into a drain mast, to a retention tank, or to a separate container for later disposal or transfer.

* * * * *